United States Patent [19]

Coursen

[11] Patent Number: 5,058,740

[45] **Date of Patent: * Oct. 22, 1991**

[54] GARMENT BOX

[75] Inventor: David D. Coursen, Garland, Tex.

[73] Assignee: Gaylord Container Corporation, Deerfield, Ill.

[ * ] Notice: The portion of the term of this patent subsequent to Jul. 31, 2007 has been disclaimed.

[21] Appl. No.: 468,571

[22] Filed: Jan. 23, 1990

Related U.S. Application Data

[63] Continuation-in-part of Ser. No. 248,681, Sep. 23, 1988.

[51] Int. Cl.[5] ..... B65D 5/08; B65D 85/18

[52] U.S. Cl. ..... 206/288; 206/299; 229/110

[58] Field of Search ..... 206/279, 288, 289, 290, 206/299, 297; 229/110

[56] References Cited

U.S. PATENT DOCUMENTS

| | | | |
|---|---|---|---|
| 911,278 | 2/1909 | Wilms | 206/299 X |
| 1,836,433 | 12/1931 | Batts | 206/279 |
| 2,562,444 | 7/1951 | Beer | 206/279 |
| 2,657,792 | 11/1953 | Ward | 206/288 |
| 2,883,042 | 4/1959 | Richer | 206/299 X |
| 3,512,697 | 5/1970 | Robinson | 229/109 |
| 3,565,242 | 2/1971 | Konkoli | 206/290 |
| 3,633,815 | 1/1972 | Rosenburg, Jr. | 229/110 |
| 3,999,657 | 12/1976 | Doskocil | 206/289 |
| 4,318,472 | 3/1982 | Nauheimer et al. | 206/289 |
| 4,375,847 | 3/1983 | Picco | 206/315 |
| 4,678,079 | 7/1987 | Henning | 206/279 |
| 4,773,533 | 9/1988 | Greene | 206/288 |
| 4,773,538 | 9/1988 | Crawford | 206/289 |
| 4,793,546 | 12/1988 | Nunn | 229/109 |
| 4,944,395 | 7/1990 | Coursen | 206/279 X |

*Primary Examiner*—Paul T. Sewell
*Assistant Examiner*—Jacob K. Ackun, Jr.
*Attorney, Agent, or Firm*—Kirkland & Ellis

[57] ABSTRACT

The invention is a hexagonal garment box including a novel hanger apparatus formed by flaps of two opposing walls of said box. The hanger apparatus includes a hanger bar formed from a foldable flap, supported by a slot in an opposing wall of said box and another flap from the opposing wall which extends over the hanger bar to secure and hold any hangers placed between the two flaps in position within the garment box.

12 Claims, 3 Drawing Sheets

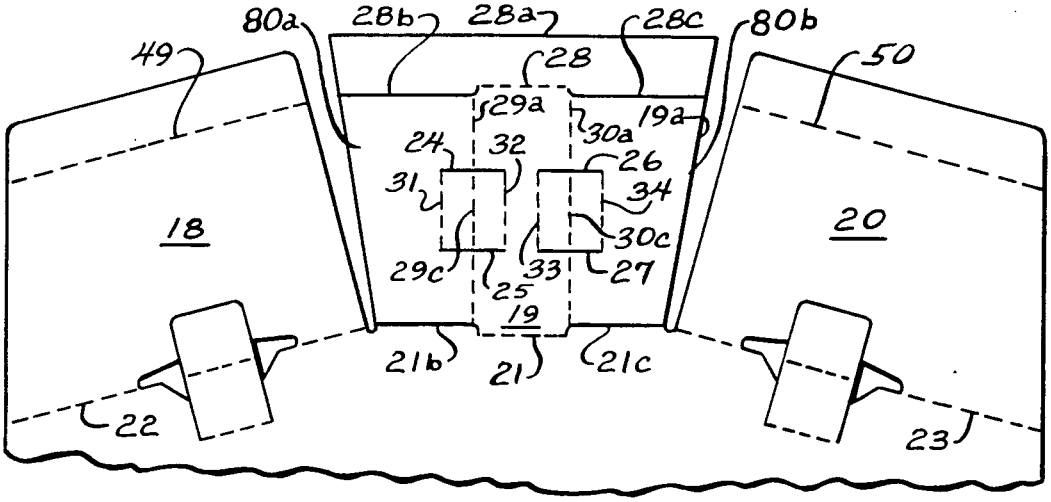
FIG. 2
FIG. 3
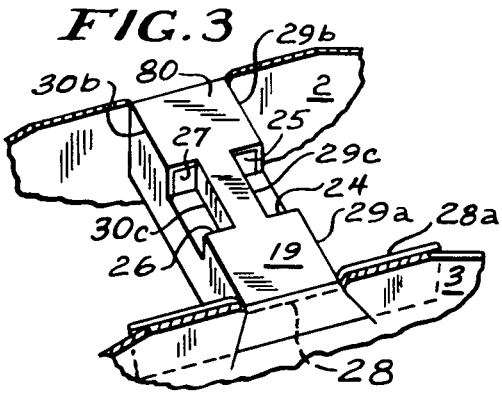
FIG. 4
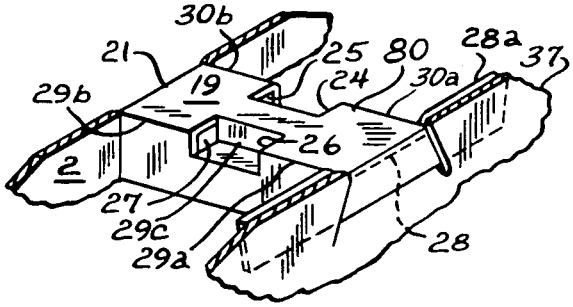
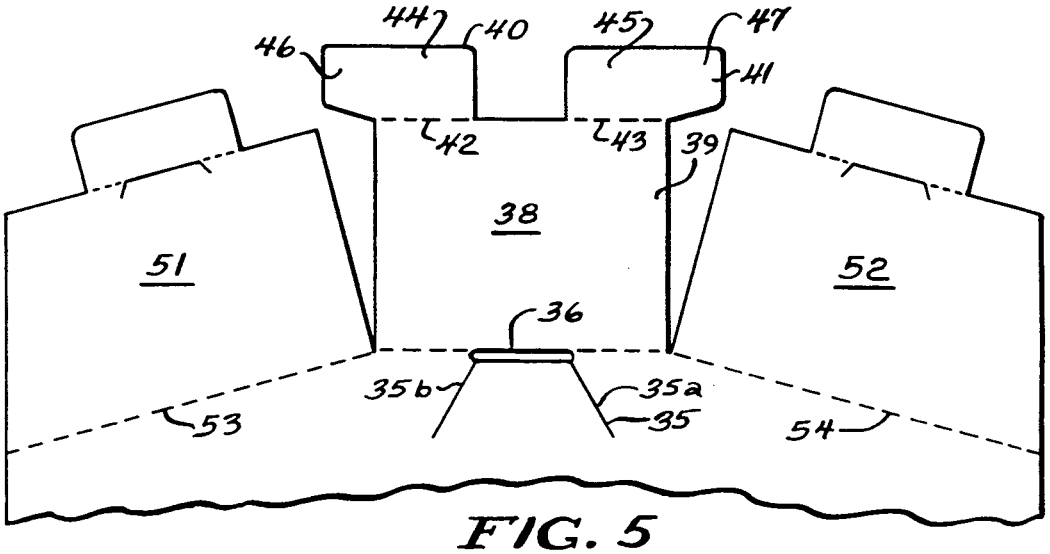
FIG. 5

FIG. 6
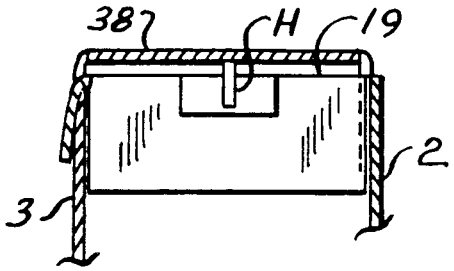
FIG. 7
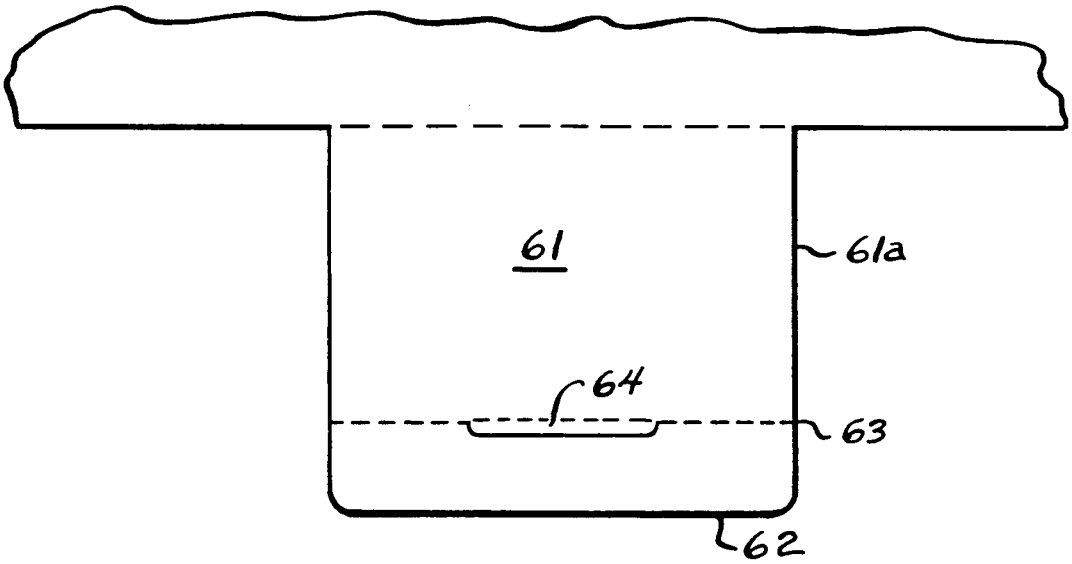
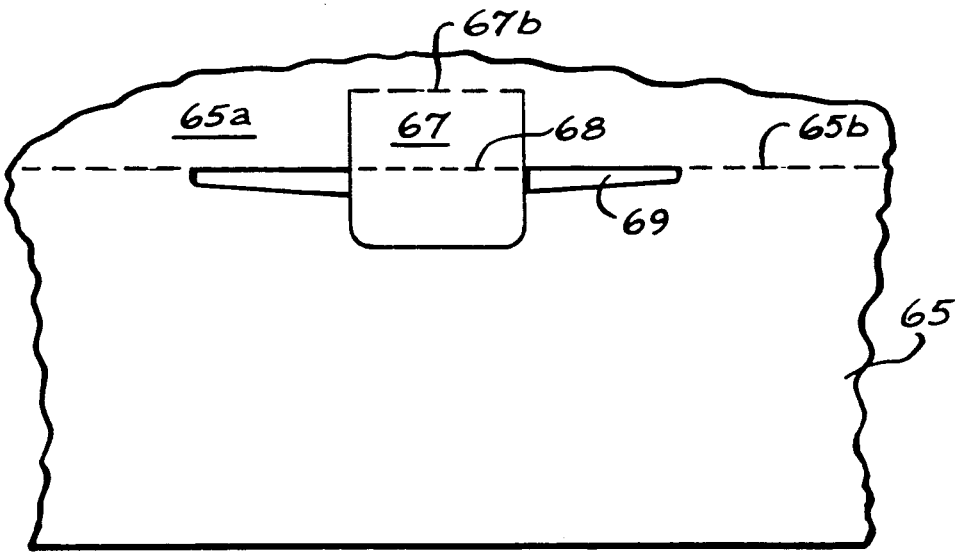
FIG. 8

GARMENT BOX

This application is a continuation-in-part of U.S. patent application Ser. No. 07/248,681, filed Sept. 23, 1988.

BACKGROUND OF THE INVENTION

1. Field of the Invention

This invention relates to a garment box, suitable for shipping, with a novel hanger apparatus for supporting hangers which carry apparel or clothing within the garment box.

2. Description of the Art

It has heretofore not been possible to form a garment box, suitable for shipping, with a hanger apparatus for holding and securing hangers within the garment box which is constructed from two flaps extending from opposing walls of the garment box. The two flaps are both integral with the garment box and extend from opposing walls of the garment box. One flap forms a hanger bar for holding the hangers. The other flap from the opposing wall extends over the hanger bar to secure the hangers within the garment box. Prior art garment boxes have been unsuitable for shipping clothes on hangers, especially when the boxes are shipped by airplane. Clothes are wrinkled because the hanger bars used to hold hangers do not adequately hold or secure the hangers carrying the clothes within the garment box. In addition, many prior art boxes are rectangular in shape and frequently jam airline luggage conveyor systems when the conveyor turns a corner. Also, if a portion of the conveyor system ascends or descends and then abruptly flattens to a horizontal level, the rectangular shape of many prior art boxes jams the conveyor system. Moreover, many prior art boxes have hangers extending outside of the box which often tear the conveyor belt as the boxes move along the airline luggage conveyor system.

U.S. Pat. No. 2,883,942, patented Apr. 21, 1959, describes a garment box for shipping. The garment box is trapezoidal in shape. A flap extending from a wall of the garment box includes a plurality of slots and apertures for holding the hanger hooks within the box. However, the hangers are not easily accessible and are not securely held in place.

U.S. Pat. No. 4,119,197, issued Oct. 10, 1978, describes a garment box for shipping. The garment box includes a separate apparel hanger receiving element which is removable and engages a top wall of the outer rectangular shipping box. The hanger receiving element retains the hook portion of hangers without locking or holding the hangers in position within the box. Due to the configuration of the apparel hanger receiving element, hangers may slip off the element, thereby enabling the clothes placed on the hangers to become wrinkled and crumpled.

U.S. Pat No. 4,318,472, issued Mar. 9, 1982, describes a rectangular garment box formed from a unitary sheet of scored paperboard. The paperboard is folded along fold lines to form a pair of connected rectangular tray sections. The first tray section has a slotted end wall which receives the hanger hooks of hangers placed within the garment box. The other tray section has an end wall which cooperates with the slotted end wall of the first tray section. The cooperating end wall has an aperture which locks the hooks of hangers placed in the slot of the first tray section outside garment box.

Clearly, the hangers are not held in position within the garment box.

U.S. Pat. No. 4,342,389, issued Aug. 3, 1982, describes a rectangular garment box. The garment box includes a hanger bar formed from flaps extending from the ends of side walls of the container body. The flaps are retained in position between an end wall of the container body and an inner locking wall. Although the hanger bar is contained within the box, the hangers on the hanger bar are not held in position and can slip off the hanger bar when the box is being transported.

Accordingly, a primary object of the present invention is to provide a garment box with a hanger apparatus constructed from flaps extending from the walls of the garment box which can hold the hangers securely in position within the box.

Another object of the present invention is to provide a sturdy, durable box for shipping garments.

Yet another object of the invention is to provide a garment box which is suitable for shipment by airplane and through airports.

A further object of this invention is to provide a garment box with flaps securely closed.

A still further object of this present invention is to provide a garment box which can be easily handled.

SUMMARY OF THE INVENTION

The foregoing and other objects, advantages and features of the invention may be achieved by a garment box formed from a unitary blank of corrugated paperboard. The paperboard is folded to form a garment box comprising a pair of side walls parallel to each other and disposed perpendicularly to a front wall and a back wall, at the edges of the front and back wall. More particularly, the garment box includes a hanger apparatus formed by at least a pair of flaps. A first flap extends from the front wall and a second flap extends from the back wall. The first flap is extending perpendicularly and inwardly from the front wall folded to form a hanger bar. The second flap extending perpendicularly from the opposing back wall over the hanger bar, holds and secures hangers placed on the hanger bar within the garment box. The first flap engages and is supported by a slot in the opposing back wall. Any additional flaps extending from the remaining sides of the garment box are folded to close the garment box. The flaps are secured by closing mechanisms such as tabs. Double tuck lock closure tabs provide a stronger mechanism to securely close the flaps. In addition, the garment box includes handles so that the box can be carried in a vertical or horizontal position to provide easy handling for all people.

BRIEF DESCRIPTION OF THE DRAWINGS

FIG. 2 is a plan view of a portion of the hanger apparatus showing the cut and scored top flaps extending from the front hexagonal wall including the flap which is foldable to form the hanger bar according to the preferred embodiment of the present invention.

FIG. 3 is a perspective top view of the flap when the box is in the closed position shown in FIG. 2 extending perpendicularly between the front and back walls and folded to form the hanger bar which is part of the novel hanger apparatus according to the present invention.

FIG. 4 is a perspective side view of the flap shown in FIG. 3 when the box is in the closed position extending between the front and back walls and folded to form the hanger bar which is part of the novel hanger apparatus according to the present invention.

FIG. 5 is a plan view of a portion of the hanger apparatus showing the preferred embodiment of the garment box top flaps of the opposing or back octagonal wall of the garment box when the box is in the open position including the flap, when extended perpendicularly and inwardly from the back wall, which covers the hanger bar and holds and secures the hangers in position on the hanger bar.

FIG. 6 is a side view of the hanger apparatus with a hanger which is held and secured within the garment box on the hanger apparatus formed by the flaps when the garment box is in the closed postion.

FIG. 7 is the plan view of the preferred embodiment of one of the flaps of the garment box, in its opened position; showing the double tuck lock closure tabs used to securely close the flaps.

FIG. 8 is a plan view of the preferred embodiment of an opposing flap of the garment box, in its opened position, which engages the flap illustrated in FIG. 7 by double tuck lock closure tabs.

DETAILED DESCRIPTION OF THE INVENTION

The invention relates to a garment box with a hanger apparatus. Hangers carrying clothes placed in the hanger apparatus are held or secured in position within the garment box. The garment box is closed by flaps extending from the top and the bottom of the garment box. In the preferred embodiment, any additional flaps other than those forming the hanger apparatus are closed and secured in the closed position by double tuck lock closure tabs.

Figure 1:
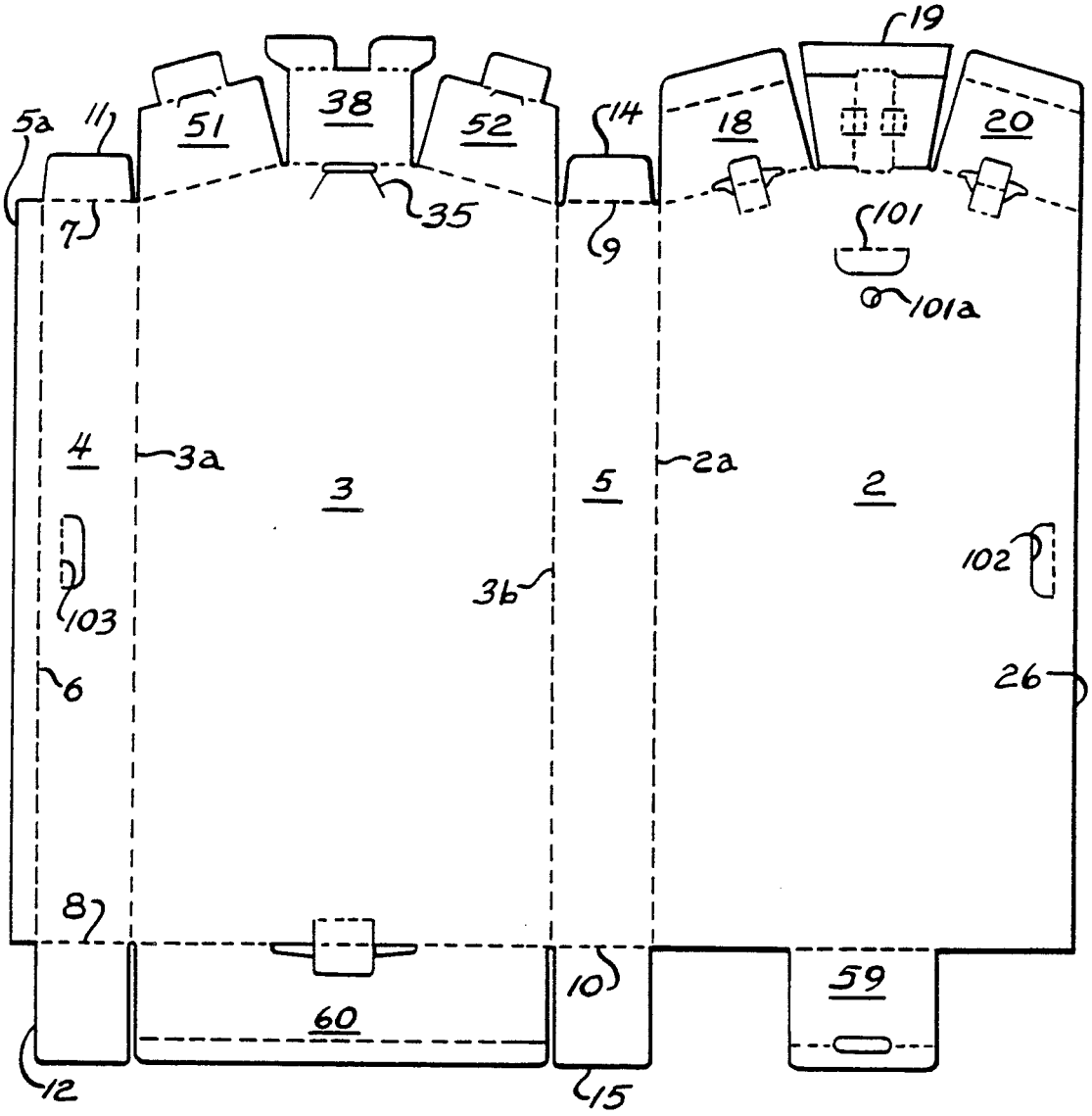
FIG. 1 is a plan view of a cut and scored corrugated blank in its flattened position which is foldable to form a garment box, according to a preferred embodiment of the present invention.

Referring to FIG. 1, the garment box (1) is constructed from a cut and scored corrugated blank paperboard which includes a front wall (2), a back wall (3), a first side wall (4), and a second second side wall (5). The garment box is formed with the front wall, the back wall and the two side walls extending perpendicularly between the front and back walls. In one of the preferred embodiments, the front and back walls are hexagonal, to facilitate the movement of the garment box along airline luggage conveyor systems. In the most preferred embodiment, the front and back walls are octagonal. In addition, either the octagonal or hexagonal shape of the box outlines the shape of hangers placed within these garment boxes. The side walls are foldable with respect to the front and back walls at the edges thereof along fold line (2*a*) located between the second side wall (5) and front wall (2); fold line (3*a*) located between the back (3) and first side wall (4) and fold line (3*b*) located between the second side wall (5) and back wall (3).

The first side wall (4) and the front wall (2) interface together at a foldable joint (6) formed by a wall portion (5*a*) of the garment box extending from the first side wall (4). The extended wall portion (5*a*) is placed within the box. The walls at the joint are held together either by glue or tape. In the preferred embodiment, glue is spread on the outside surface of the extended wall portion (5*a*) so that the extended wall portion (5*a*) adjoins and adheres to the inside surface of the front wall (2). In the alternative tape may be placed on the outside of the garment box once the extended wall portion (5*a*) is placed inside the box so that the tape adheres to the outer surface of the front wall (2) and the outer surface of the adjoining first side wall (4).

The first side wall (4) has a top flap (11) and bottom flap (12). A fold line (7) separates the first side wall (4) from the top flap (11). A fold line (8) separates the first side wall (4) from the bottom flap (12). The second side wall (5) also has a top flap (14) and a bottom flap (15). A fold line (9) extends at the boundary between the top flap (14) and the second side wall (5). A fold line (10) is positioned between the second side wall (5) and the bottom flap (15). As shown in FIG. 1, the first side wall (4) has a rectangular top flap (11), and a rectangular bottom flap (12).

The front wall (2) and back wall (3) of the garment box also have top and bottom flaps. The configuration and number of flaps is dependent upon the shape of the final garment box. However, each garment box has at least opposing flaps on the front and back walls forming the hanger apparatus. Each garment box has a first flap which forms a hanger bar and a second flap which extends from the opposing wall to hold and secure hangers between the first flap and the second flap in position within the box. The flaps for a preferred embodiment of the garment box, an hexagonal garment box, are described below.

FIG. 2 illustrates the top flaps of the front wall (2) of a preferred hexagonal garment box (1). There are three top flaps (18, 19, 20), extending from the top edges of the hexagonal front wall (2). The three top flaps include a middle top flap (19) and two side top flaps (18, 20). A fold line (21) separates the middle top flap (19) from the top of the hexagonal front wall (2). The middle top flap (19), which is primarily trapezoidal, is rotatable along the border of the front wall (2) as defined by fold line (21). In addition, fold line (22) separates side top flap (18) from the hexagonal front wall (2). Side top flap (18) is rotatable along the border of the front wall (2) as defined by fold line (22). Fold line (23) is positioned between the hexagonal front wall (2) and side top flap (20). Side top flap (20) is also rotatable along the border of the front wall (2) as defined by fold line (23).

The middle top flap (19) is shown its unfolded position with fold lines and slits in FIG. 2. The middle top flap (19) extends from the front wall (2), is rotated ninety degrees along fold line (21) and is folded to form a hanger bar, is shown in FIG. 3. The opposing flap (38) is folded over flap (19) to close the garment box. FIG. 3 illustrates the top, perspective view of the flap folded to form the hanger bar (80). FIG. 4 illustrates the perspective view of the flap (19) folded to form the hanger bar (80). As seen in the Figures, the middle top flap (19) is primarily trapezoidal. A fold line (21) separates the middle top flap from the front wall (2). A fold line (28), parallel to the separating fold line (21) along the full length of trapezoid (19*a*), is positioned approximately where the width of flap (19) exceeds the distance between the front (2) and back walls (3) when the box is closed. The trapezoid (19*a*) is divided into three approximately equal regions by fold line (29), which is divided into segments (29*a,b,c*) and fold line (30) which is divided into segments (3O*a,b,c*). When the flap is in its unfolded position, fold line (29) extends perpendicularly between fold line (21) and fold line (28). Fold line (29*a*) extends from the fold line (28) to slit (24). Fold line (29*b*) extends from fold line (21) to slit (25). Fold line (29*c*) extends from slit (24) to slit (25). Fold line (29*a*), fold line (29*b*) and fold line (29*c*) are aligned. When the flap is in its unfolded position, fold line (30) is parallel to the fold line (29) and extends perpendicularly from fold line (28) to fold line (21). Fold line (3O*b*) extends from fold line (21) to slit (27). Fold line (3O*c*) extends from slit (26) to slit (27). Fold line (3O*b*) is parallel to fold line (29*b*) and extends the same distance as fold line (29*b*) between fold line (21) and slit (27). In addition, fold lines (3O*a*), (3O*b*) and (3O*c*) are aligned. A slit (28*b*) is formed along the fold line (28) from one edge of the rectangle (19*a*) to the fold line (29*a*). Another slit (28*c*) is formed from the outer edge of the rectangle (19*a*) to fold line (3O*a*). In addition, a slit (21*b*) is placed along the separating fold line (21) in a similar manner as the slits (28*b*) along fold line (28) between the one edge of the rectangle (19) to the fold line (29*b*). Another slit (21*c*) is formed along fold line (21) from the opposing edge of the rectangle (19*a*) to the fold line (3O*b*).

A first set of parallel slits (24, 25) and a second set of parallel slits (26, 27) are centrally located in the trapezoid (19*a*), parallel to the fold line (21) and fold line (28) as seen in FIG. 2. In the preferred embodiment, three score lines (31, 29*c*, 32) are positioned perpendicularly between the first set of parallel slits (24, 25). The first score line (31) extends between slits (24, 25), at one end of the slits (24, 25). The second score line (32) extends between the two slits (24, 25) at the other end of the slits (24, 25). The third scored line (29*c*) extends between slits (24, 25). In the unfolded position, the third scored line (29*c*) is in alignment with the fold line (29*a*) and the fold line (29*b*). Three scored lines (33, 30*c*, 34) are positioned perpendicularly between the second set of parallel slits (26, 27). The first scored line (33) extends between the slits (26, 27) at one end of the slits (26, 27). The second scored line (34) extends perpendicularly to the slits (26, 27) at the opposing end of the slits (26, 27). The third scored line (3O*c*) extends between the slits (26, 27), in alignment with the fold line (30*a*) and the fold line (30*b*). In the alternative, the area between the first (24, 25) and second set (26, 27) of parallel slits may be removed to form square or rectangular openings in the trapezoidal section (19*a*).

Figure 9:
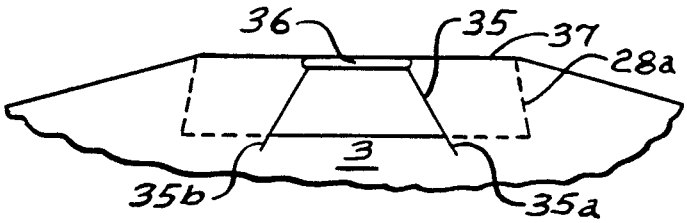
FIG. 9 is a front view of the folded top flap of the secured to the back wall.

The middle top flap (19) is then folded along the respective fold lines to form the hanger bar (80). The flap (19) is rotated ninety degrees along fold line (21) to a horizontal position between front wall (2) and back wall (3). The segment (80*a*) of the flap (19) formed between fold lines (29*a*) and (29*b*) is folded downwardly. The segment (80*b*) of the flap (19) between fold lines (30*a*, 30*b*) is folded downwardly. Due to the placement of the score lines between the first set of parallel slits (24, 25) and the second set of parallel slits (26, 27), the region (29*c*, 30*c*) between the slits folds inwardly when segments (80*a*, 80*b*) are folded downwardly. FIG. 3 illustrates a top view of the flap (19) folded in the manner described above to form the hanger bar (80). FIG. 4 illustrates a side view of the flap (19) in its folded position. The hanger bar (80) as placed between the front (2) and back (3) walls is supported on the back wall (3) by a slot (35) formed in the back wall (3). FIG. 9 illustrates the placement of the slot (35) in the back wall. In the preferred embodiment, the slot (35) is placed at the top of the back wall (3). In the preferred embodiment, the slot (35) is formed by an elongated oval cutout opening (36) along the fold line (37) with two slots (35*a*, 35*b*) extending outwardly from the ends of the oval opening (36). The hanger bar (80) engages and is supported by this slot (35) on the back wall of garment box, due to segment (28*a*) of the flap being received in slot (35).

The top middle flap (38) of back wall (3) which is part of the hanger apparatus is illustrated in FIG. 5. The top middle flap includes a rectangular section (39) and two tabs (40, 41) extending from the top corners of the rectangle. A fold line (42) separates the tab (40) from the rectangular section (39). A fold line (43) separates the tab (41) from the rectangular region (39). Tab (40) in the preferred embodiment comprises a rectangular region (44) and a trapezoidal region (46). A scored line (48), perpendicular to the fold line (42) and aligned with one side of rectangle (39), separates the trapezoidal region (46) from the rectangular region (44) on the tab (40). Tab (41) also comprises a rectangular region (41) separated from a trapezoidal region (47) by a scored line (49), perpendicular to the fold line (43) and aligned with the other side of rectangle (39).

The top middle flap is rotated ninety degrees along fold line (37) towards front wall (2) to a horizontal position between front wall (2) and back wall (3) and over hanger bar (80). Tab (40) is folded downwardly at fold line (42). In addition, the trapezoidal region (47) of tab (40) is folded inwardly along fold line (48). Tab (41) is folded downwardly at fold line (43). The trapezoidal region (47) is folded inwardly with respect to the rectangular region (45) at fold line (49). The top middle back flap (38) is then placed over the hanger bar (80) to hold or secure any hangers placed on the hanger bar in position as illustrated in FIG. 6. The tab (40) of the top middle back flap (38) in its folded position slides into and is engaged by the slit (21*c*) formed along the separating fold line (21) (illustrated in FIG. 2). The tab (41) in its folded position slides into and is engaged by the slit (21*b*) formed along the separating fold line (21). This arrangement of the top middle back flap (38) over the middle top flap (19) secures and engages all hangers placed on the hanger bar (80) within the garment box and prevents the hangers from falling off the hanger bar (80).

In accordance with the preferred embodiment of the hexagonal garment box, the remaining top side flap of the front (2) and back wall (3) will be described. The remaining front wall top flaps are illustrated in FIG. 2, whereas the remaining back wall top flaps are illustrated in FIG. 5.

The two side top flaps (18, 20) of the front wall each are illustrated in FIG. 2. Top flap (18) is primarily trapezoidal. A fold line (22) separates top flap (18) from the front wall (2). A second fold line (49) extends across top flap (18) approximately where the flap exceeds the distance between the front (2) and back wall (3) when the box is in the closed position. Top flap (20) is also primarily trapezoidal with a fold line (23) separating the flap from the front wall (2). A second fold line (50) extends across top flap (25) approximately where the flap exceeds the distance between the front wall (2) and back wall (3) when the box is in the closed position. The front wall side top flaps (18, 20) are folded along with the back wall side top flaps (52, 51) to close the garment box by any type of closing mechanism known in the art. In the most preferred embodiment, double tuck lock closure tabs, which will be described, are used.

The two back wall side top flaps (51, 52) are illustrated in FIG. 5. Each of the back wall side top flaps (51, 52) is trapezoidal. A fold line (53, 54) separates each of the flaps from the back wall (3). The back wall side top flaps (51, 52) are folded along with the front wall side top flaps (18, 20), to close the garment box along their respective fold lines. The back wall side top flaps (51, 52) are engaged with their counterpart front wall side top flaps (20, 18). The flaps are secured and closed by any locking mechanism known in the art. In the most preferred embodiment of this invention, double tuck lock closure tabs may be used.

The bottom flaps on the front wall, back wall and side walls can be any type of flaps which are lockingly engaged to close the garment box. As previously described and illustrated in FIG. 1, the bottom flaps (12, 15) of the first and second side walls (4, 5) are formed by rectangular sections. According to the preferred embodiment of this invention these side wall bottom flaps (12, 15) are folded perpendicularly inwardly from the side walls (4, 5) when the box is in the closed position. The bottom flap (59) of the front wall and the bottom flap (60) of the back wall are generally rectangular. The bottom flaps (59, 60) of the front wall (2) and back wall (3) are folded over the side wall bottom flaps (12, 15) to close the garment box. The bottom flaps (50, 60) are interlockingly engaged by any closing mechanism known in the art. In the most preferred embodiment, the double tuck lock closure tabs are used to engage the front wall bottom flap (59) with the back wall bottom flap (60). However, other closing mechanisms may be used.

The invention also relates to a locking mechanism used to securely close any additional flaps extending from the walls of the garment box so as to close the garment box. The closing mechanism comprises double tuck lock closure tabs. In the preferred embodiment, double tuck lock closure tabs are used to engage the two side top flaps (18, 20) of the front wall (2) with the two back side top flaps (52, 51). In addition, the double tuck lock closure tabs are used to engage the bottom flaps of the front and back walls (59, 60).

The generic double tuck lock closure tabs which can be used to engage two flaps extending from opposing walls in accordance with the preferred embodiment of this invention are illustrated in FIGS. 7 and 8. A first flap (61) extends from one wall of a garment box. The first flap (61) consists of rectangular region (61*a*) and a tab (62) extending from the center of the unattached end of the rectangular region (61*a*). A fold line (63) separates at the tab (62) and rectangular region (61*a*). In addition to the fold line (63), an elongated slot (64) is positioned at the center of the tab adjacent fold line (63). A second rectangular flap (65), illustrated in FIG. 8, extends from the opposing wall (65*a*) of the garment box. A scored line (65*b*) separates the wall (65*a*) of the garment box from the second flap (65). A score line (66), parallel to the scored line (65*b*), extends across the second flap (65) at the point at which the flap (65) folds into the garment box. A rectangular component (67) with a rounded section at its top and a base (67*b*) is cut from the second flap (65) and wall (65*b*) along all sides except the base (67*b*). The component (67) as illustrated in FIG. 8 is found in the center of the second flap (65). A fold line (68) is scored on the component (67) to separate the wall (65*a*) section of the component from the remainder of the component. The fold line (68) is aligned with the score line (65*b*). A fold line is positioned along the base (67*b*) of the component (67). In addition, an elongated slot (69) is formed adjacent the scored line (65*b*) at the center of the second flap (65). The slot (69) is configured so that the tab (62) of the first flap (61) fits therein.

The double tuck lock closure tab is assembled in the following manner. First, the second flap (65) is rotated ninety degrees inwardly to a horizontal position. Second, the first flap (61) with the tab (62) is rotated inwardly to a horizontal position. The tab (62) of the first flap is placed into the slot (69) of the second flap (64). The component (67) is then placed into the slot (64) of the first flap (61) to provide a locking engagement between all three pieces.

In addition, this invention relates to the easy handling of garment boxes as illustrated in FIG. 1. A handle is provided near the top portion of the box on the front wall (2). This handle (101) enables a person to carry the garment box in a generally vertical manner with respect to the orientation of the hangers placed on the hanger apparatus (80). The handle (101) may be formed from a cutout slot. An additional round cutout (101*a*) may be placed below handle (101). This configuration provides for attachment of identification and destination "string type tags". This configuration may also enable one to put his hand in solely one cutout or to use one's four fingers in the cutout and the thumb in the round cutout. An additional handle may be provided so that the garment box may be carried horizontally with respect to the garments hanging on hangers held and secured on the hanger apparatus. In the preferred embodiment this additional handle is formed by two cutout slots (102, 103). A first handle cutout slot (102) is formed on the front wall (2). The first handle cutout slot (102), placed in the middle of the front wall (2), oriented perpendicularly to the hanger bar (80) is placed in the middle of the front wall (2), as illustrated in FIG. 1. A second handle cut out (103) is placed on the first side wall (4) adjacent to the front wall (2) containing the first handle cutout slot (102) when the garment box is formed. This configuration enables one to put his hand in solely one slot or to use one's four fingers in one slot and the thumb in the other slot. In the most preferred embodiment of the garment box, both sets of handles are provided to give the person carrying the box an option of carrying the box vertically or horizontally.

From the foregoing description, one skilled in the art can easily ascertain the essential characteristics of this invention and without departing from the spirit and scope thereof can make various changes and modifications of the invention to adopt it to various usages and conditions.

I claim:

1. A garment box formed from a unitary blank of corrugated paper board including a hanger apparatus for holding hangers comprising:

a. a hexagonal front wall and a hexagonal back wall disposed parallel to each other;

b. a first side wall extending parallel to a second side wall, said first and second side walls disposed perpendicularly between said front wall and said back wall;

c. a foldable first slap extending from the top of said front wall, said first flap rotable inwardly toward said back wall along a first fold line located at the tope of said front wall to form said hanger apparatus, said first flap comprising:

i) an engaging portion for securing said first flap to said back wall;

ii) a hanger bar portion, having a first score line and a second score line both extending perpendicularly from said first fold line to said engaging portion and dividing said hanger bar portion into three segments; and iii) a third score line parallel to said first fold line between said engaging portion and said hanger bar portion;

d. means on the back wall for receiving and supporting said engaging portion of said first flap;

e. a foldable second flap extending from the top of said back wall, said second flap being rotable inwardly toward said front wall along a second fold line location at the top of said back wall; and f. means for securing said second flap, whereby said first slap forming said hanger apparatus is folded inwardly along said first fold line and downwardly along said first, second and third score lines to form said hanger bar for supporting hangers, said engaging portion is secured in the means for receiving and supporting on said back wall, and said second flap is folded inwardly along said second fold line and over said first flap and secured to said front wall so that any hangers placed on said hanger bar portion are secured between said flaps.

2. A garment box as claimed in claim 1 wherein said first score line extends from one end of said first fold line to one end of said third score line, said second score line extends from the other end of said first fold line to the other end of said third score line, and said three segments include a first segment having opposing side walls extending between an open side of said flap and said first score line, a second segment bordered by said first fold line, said third score line and said first and second score lines, and a third segment having opposing side walls extending between said second score line and the opposite open side of said flap.

3. A garment box as claimed in claim 1 or 2 wherein said hanger bar portion further includes:

a. a first pair of parallel slits extending perpendicularly through said first score line in said first and second segments and positioned to divide said first score line into three portions;

b. a third fold line located in said first segment extending between one set of ends of said first pair of parallel slits;

c. a fourth fold line located in the second segment extending between the other set of ends of said first pair of parallel slits;

d. a first depressible region defined by said first pair of parallel slits and said third and forth fold lines;

e. a second pair of parallel slits extending perpendicularly through said second score line in the second and third segments and positioned to divide said second score line into three portions;

f. a fifth fold line located in said second segment extending between two ends of said second pair of parallel slits;

g. a sixth fold line located in said third segment extending between the other two ends of said second pair of parallel slits; and h. a second depressible region defined by said second pair of parallel slits and said fifth and sixth fold lines, whereby when said flap is folded downwardly to form a hanger bar portion, said first and second regions are depressed to enable hangers to be positioned on the hanger bar portion.

4. A garment box as claimed in claim 3, wherein said first pair of parallel slits comprises a first slit and second slit which are divided into equal portions by said first score line, and said second pair of parallel slits comprises a third slit and a fourth slit, said third and fourth slits are divided into equal portions by such second score line.

5. A garment box as claimed in claims 1, 2, 3 or 4 having handle means, said handle means comprising:

(i) a first cutout handle formed below said hanger apparatus in the front wall near the top of the garment box;

(ii) a second cutout handle placed approximately halfway along the height of said front wall, said second cutout handle placed perpendicularly with respect to said first cutout handle;

(iii) a third cutout handle place wall adjoining the front wall, perpendicularly with respect to said first cutout handle;

whereby the garment box may be carried vertically by using the first cutout handle or horizontally by using the combination of the second and third cutout handles with respect to said hanger apparatus.

6. A garment box as claimed in claim 5 wherein a round cutout is placed below the first coutout handle.

7. A garment box as claimed in claims 1, 2, 3, 4, or 5 wherein said first flap is rotated ninety degrees inwardly.

8. A garment box as claimed in claims 1, 2, 3, 4, 5, or 7 wherein said garment box includes additional flaps extending from said front wall and said back wall; such additional flaps are folded to close said garment box and are secured by double tuck lock closure tabs.

9. A garment box as claimed in claim 1, wherein said means for securing said second flap comprises a first slit formed along the first fold line from the edge of the first flap to the first score line and a second slit formed along the first fold line from the opposite edge of the first flap to the second score line whereby said second flap is engaged by said first and second slits when placed in position to be secured to said front wall.

10. A garment box as claimed in claim 1, wherein said means for securing said second flap comprises tabs on said second flap which are engaging in apertures on said front wall.

11. A garment box as claimed in claim 1, wherein said means on said back wall from receiving and supporting said engaging portion of said first flap comprises a slot.

12. A garment box as claimed in claim 11, wherein said slot is formed by an elongated cutout opening along the second fold line with two slots extending outwardly from the ends of the opening.

* * * * *

UNITED STATES PATENT AND TRADEMARK OFFICE

CERTIFICATE OF CORRECTION

PATENT NO. : 5,058,740

DATED : October 22, 1991

INVENTOR(S) : David D. Coursen

It is certified that error appears in the above-identified patent and that said Letters Patent is hereby corrected as shown below:

Column 8, line 63, "tope" should read --top--.

Column 9, line 14, "slap" should read --flap--.

Column 9, line 50, "forth" should read --fourth--.

Column 10, line 24, "place" should read --placed on the side--.

Column 10, line 32, "coutout" should read --cutout--.

Signed and Sealed this

Sixth Day of April, 1993

*Attest:*

STEPHEN G. KUNIN

*Attesting Officer*

*Acting Commissioner of Patents and Trademarks*